United States Patent [19]

Barriac

[11] Patent Number: 4,878,604

[45] Date of Patent: Nov. 7, 1989

[54] DISPENSING CLOSURE

[75] Inventor: Jacques J. Barriac, Montgomery, Pa.

[73] Assignee: Owens-Illinois Closure Inc., Toledo, Ohio

[21] Appl. No.: 238,657

[22] Filed: Aug. 31, 1988

[51] Int. Cl.[4] ..... B65D 37/00

[52] U.S. Cl. ..... 222/209; 222/212; 222/401; 222/519; 222/522; 222/531; 222/536; 222/545; 222/559

[58] Field of Search ..... 222/533, 536, 537, 522, 222/523, 531, 524, 519, 557, 538, 499, 559, 561, 545, 209, 211, 212, 215, 401, 521; 251/75; 220/331, 351, 855 P; 215/272, 311

[56] References Cited

U.S. PATENT DOCUMENTS 1,958,429 5/1934 Hartog ..... 222/499
2,877,918 3/1959 Gardner ..... 215/311 X
3,471,066 10/1969 Micallef ..... 222/519
4,412,634 11/1983 Bennett ..... 222/536 X

*Primary Examiner*—Kevin P. Shaver
*Assistant Examiner*—Gregory L. Huson

[57] ABSTRACT

A dispensing package comprising a pressure pumping source provided by the container, and a three-piece fluid delivery system which includes closure, dip tube fitted on the closure and a delivery spout for handling light-duty liquid. The closure functions as a push-pull closure providing an "on"/"off" position for dispensing without a need to remove or replace the closure on the container. Dispensing is accomplished without the need to lift or tip the container. The closure seals in a liquid-tight condition when placed in the "off" position. The side dispensing spout can be rotated horizontally to any desired position for ease of dispensing or for shipping in an out-of-the-way position.

16 Claims, 3 Drawing Sheets

DISPENSING CLOSURE

FIELD OF THE INVENTION

This invention is directed to dispensing closures for containers in which a pressure means in the container supplies pressurized liquid through a dip tube to the closure for dispensing. More particularly the dispenser includes a closure and container (squeeze container or container with bellows); the closure includes a dip tube connected to a horizontal spout for delivery of the liquid. The spout is rotatable in a radial plane for a dispensing position and storage position. The closure includes an "on" and "off" seal.

DESCRIPTION OF THE PRIOR ART

In the prior art push-pull closures are used in dispensing liquid and utilize an integral pump and dispensing closure which contains many parts including springs, ball seals, diaphragms, pistons and various other cooperating parts. In the majority of these, the functions of dispensing and pumping the liquid are combined. Such pump dispensing devices are operable at nearly any attitude or position of the container.

SUMMARY OF THE INVENTION

The present invention has an objective of providing a dispensing package for light duty liquid that is simple and inexpensive to manufacture. The package includes a container with closure receiving finish, a dip tube, a closure and a delivery spout. The closure is secured to the container finish and provides a pull-push "on"/"-off" function, the closure sealing the liquid in the container in its "off" position without the need to remove or replace the closure on the container. The invention also includes a horizontal dispensing spout which can be rotated to any desired location on the container for dispensing liquid or for shipping purposes.

In its preferred embodiment, the liquid is pressurized by a bellows or by squeeze bottle. As the closure is in "on" position, depressing the bellows or squeezing the container forces liquid up the dip tube and through the closure and its delivery spout. When pressure of the bellows or the container is released and it returns to original position, air is sucked back into the container through the spout and dip tube into the container avoiding dripping of the liquid at the spout. The unit is therefore self-cleaning.

The present invention provides the convenience of a side or offset dispensing pump combined with a push-pull closure. The invention is easily manufactured and assembled, and moving parts of the dispensing system all but eliminated.

DETAILED DESCRIPTION OF THE INVENTION

The invention provides a container for LDL (low density liquid) that is manually pressurized to dispense the liquid. On FIG. 1 a plastic container 10 is provided with a flexible bellows 11 mounted on top of the container and connected to its interior chamber 12. Depressing bellows 11 increases the air pressure in the head space and presses on the liquid 13. This structure is a first embodiment of the invention for pressurizing the liquid for dispensing in the manner to be presently described.

Figure 2:
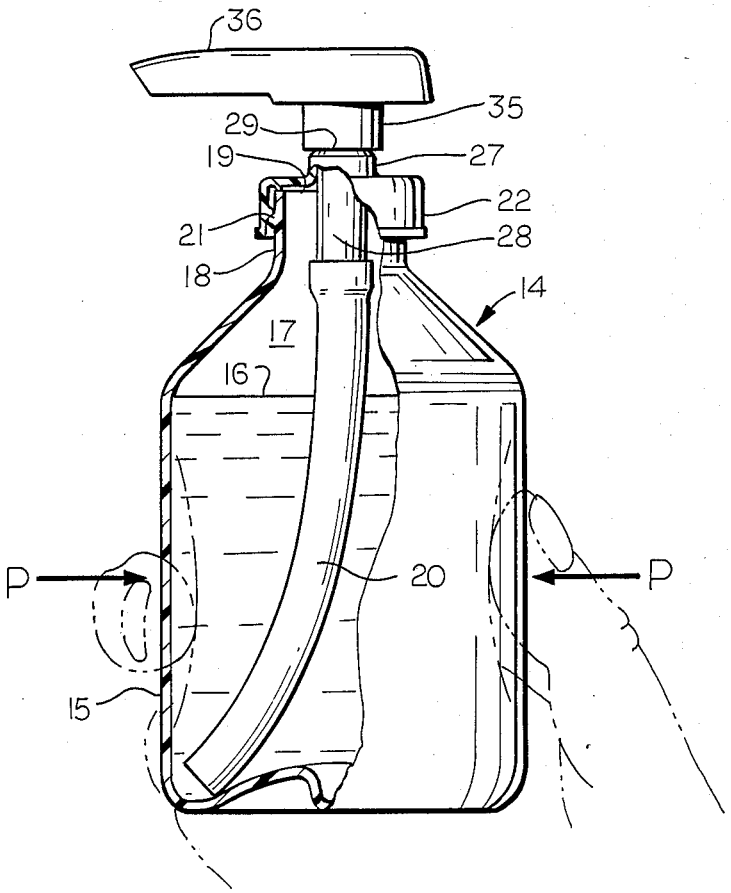
FIG. 2 is a side elevational view, partly in section, of a squeeze bottle embodiment of the invention in which liquid is pressurized in the bottle by squeezing its sides to dispense liquid through the dip tube and side delivery spout.
Figure 3:
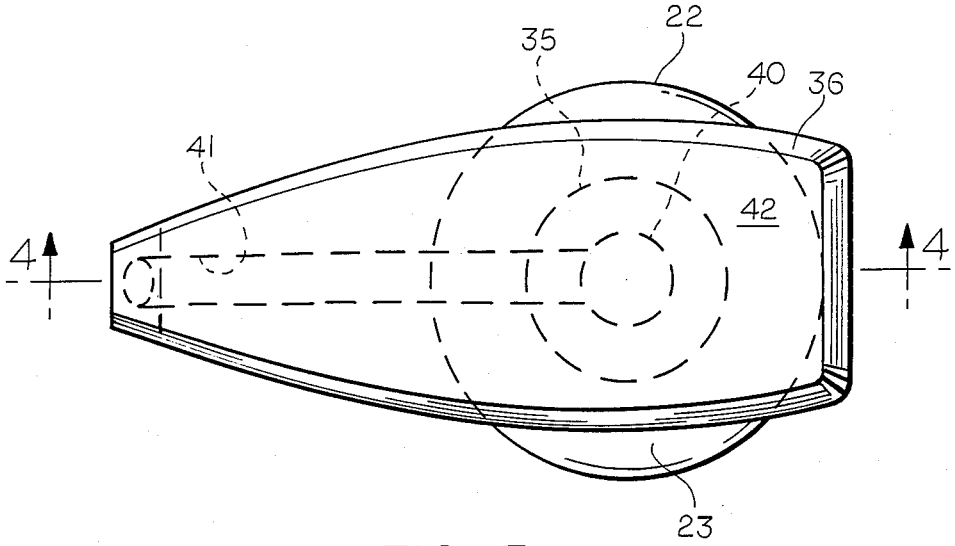
FIG. 3 is a top plan view of the embodiment shown on FIG. 2.

In another embodiment shown on FIG. 2, the liquid is contained in a plastic squeeze bottle 14 having an annular flexible side wall 15. Manual squeezing pressure applied along wall 15, such as at arrows P, will pressurize the head space in the container chamber 17 and dispense the liquid 16.

Either of these containers are provided with a neck 18 and mouth opening defined at the annular rim 19. The same numerals are applied to the same or similar structure in either of the illustrated embodiments. Both containers 10 and 14 provide a means of pressurizing the liquid contained therein. A hollow dip tube 20 is suspended in the liquid and is open at its bottom end to receive liquid from the interior of the container. Neck 18 includes external means, such as threads 21 shown on FIG. 4, by which closure 22 is attached to the container. Closure 22 includes a top wall 23 and integral skirt 24. Threads 25 are molded on the inside surface of skirt 24 and a seal, such as the inwardly and downwardly directed annular V-shaped web 26 depends from the underside of top wall 23. The annular web 26 is located to engage rim 19 of the container finish and provide a fluid tight seal between closure and container. The top wall 23 includes axial, upwardly extending tubular member 27 comprising the delivery tube of the closure. This seal permits the flow of fluid from the container and flow of air back into the container only through the tubular member 27. The lower hollow interior of member 27 receives a downwardly extending axial tube 28 press fit in place. The free lower end of tube 28 is connected with the upper end of flexible dip tube 20. The member 27 is stepped inwardly at intermediate region 29 and integral with upper tubular portion 30. At the top end of upper portion 30 is an annular external bead 31. Integral with portion 30 and spaced above its end opening is a cantilevered valve 32 secured to the wall of portion 30 by integrally molded webs 33. Valve 32 is circular and clearance between it and the end of tube portion 30 provides a fluid passage 34. The valve member is fixed at the upper end of the portion 30. The lower hollow tubular portion 35 of horizontal delivery spout 36 telescopes over portion 30 and the interior of portion 35 includes an annular bead 37. The lower opening of portion 35 is adapted to telescope over the larger tubular member 27 below the stepped tubular portion 29 connecting the upper and lower tubular portions. The external bead 31 snaps over the internal bead 37, the two forming a snap-fit connection of the spout portion 35 and the closure. This connection permits rotary swiveling motion of the delivery spout 36 on the upper tubular portion 30 of the closure.

Figure 5:
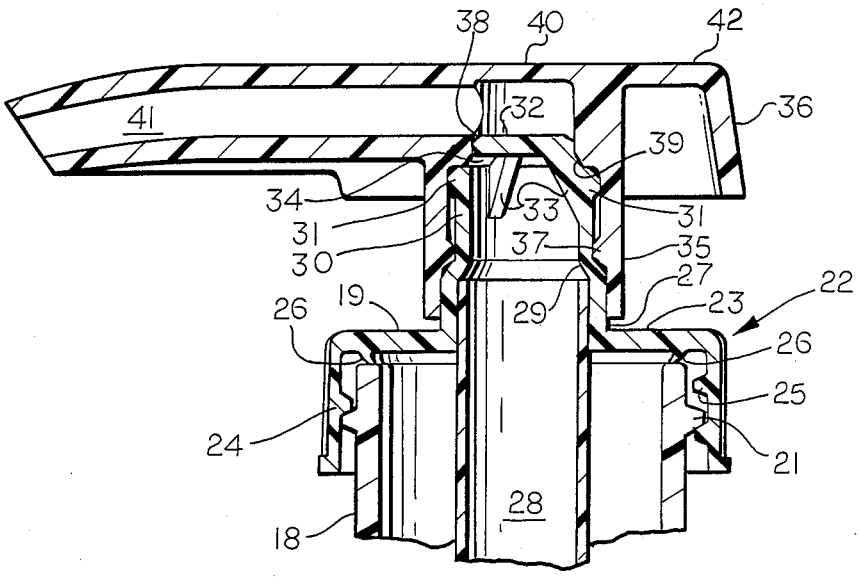
FIG. 5 is a sectional elevational view similar to FIG. 4 but showing the pull-push closure in its "off" position for sealing the container.

The interior of tubular portion 35 of the spout defines a cavity 38 which includes the chamfered seat 39 and the upright outlet passage 40. As shown on FIG. 5, circular valve member 32 is similarly chamfered and fits snugly in the seat 39 to seal off the chamber 38 from outlet passage 40. In the delivery spout 36, the passage 40 connects with the discharge outlet passage 41 from which liquid is dispensed. The delivery spout 36 includes a planar top surface 42 which provides a surface for pressing axially downwardly on the spout member lowering its position to that of FIG. 5 and placing the valve in the "off" position whereat the content of the container is sealed and disconnected from the delivery outlet 40, 41.

Figure 4:
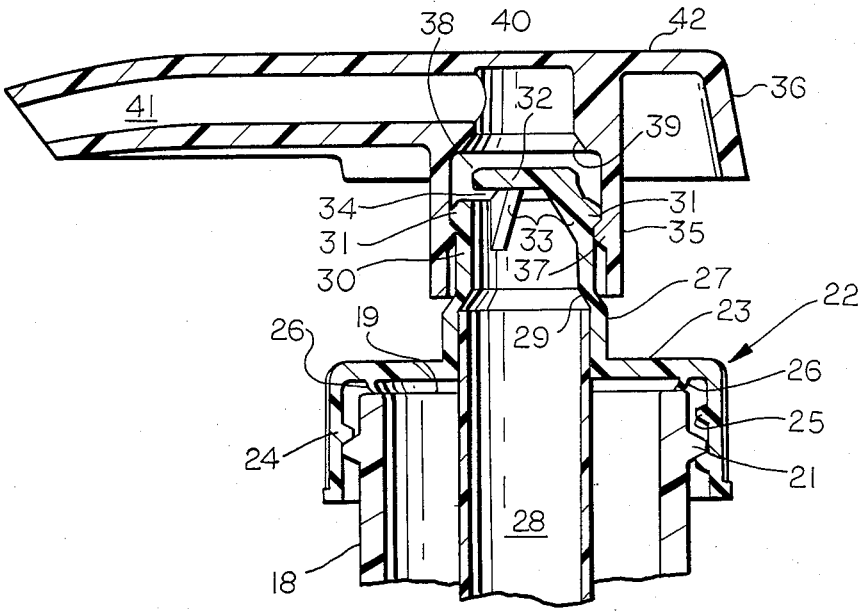
FIG. 4 is a sectional elevational view, partly broken away, taken along line 4—4 on FIG. 3, and showing the pull-push closure in its "on" position for dispensing liquid.

Grasping the underside of delivery spout 36 and lifting it will oopen the valve and passage 32, 34, thereby setting the dispensing closure in its "on" position of FIG. 4 for discharging liquid through the passageways 40, 41. The liquid in the container is pressurized by means, such as the bellows 11 of FIG. 1, or by squeeze bottle of the embodiment of FIG. 2.

Figure 1:
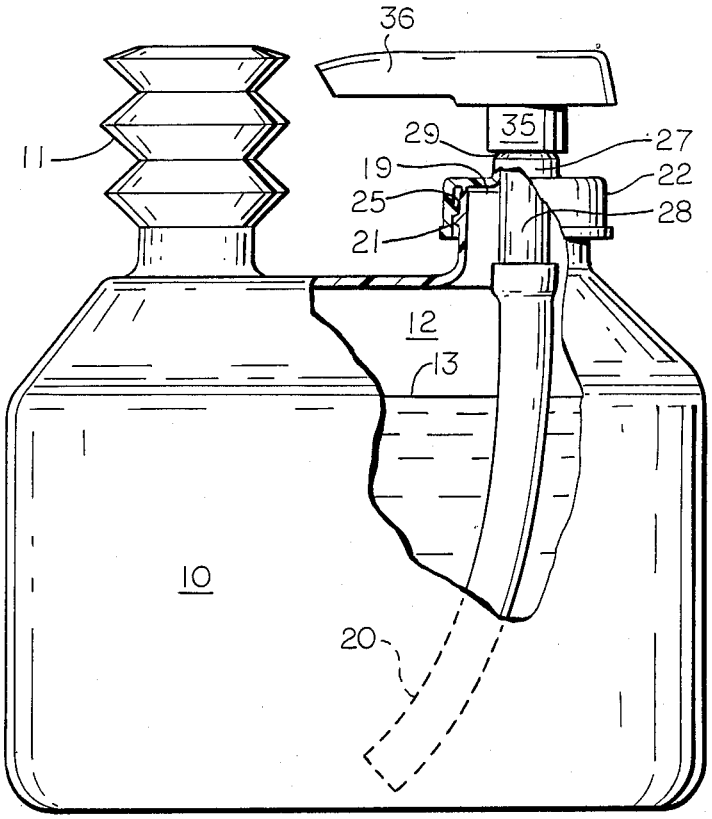
FIG. 1 is a side elevational view, partly in section, of a first embodiment of the invention utilizing a container equipped with a bellows to pressurize the interior and dispense liquid through the dip tube and horizontal delivery spout.

Another feature of the invention is illustrated on FIG. 1 in which the delivery spout 36 of the closure may be turned to an out of the way position (solid outline) for packing and shipping; and may be swiveled to a side delivery position (phantom outline) for dispensing. The structure disclosed combines the convenience of a side or offset dispensing package and a push-pull closure. In the disclosed structure, the dispensing and pumping functions are separated, i.e. push-pull spout and closure for dispensing and bellows or squeeze bottle for pumping action. The dispensing may be accomplished without lifting or tipping the container. The construction is simplified and comprises a delivery spout assembly, closure and a dip tube. The invention is economical to manufacture and assemble for use. When the liquid is pumped, the dispensing passages are self-cleaning by virtue of the fact that after pumping by squeeze bottle or bellows, air is sucked back through the spout passages and dip tube into the container after the release of pumping force which avoids dripping or clogging of the dispenser.

Having described preferred embodiments of the invention in some detail for purposes of illustrating and example of the known best mode of the invention, it is understood that changes and modifications may be practiced within the scope of the invention as set forth in the appended claims.

What is claimed is:

1. A liquid dispensing closure assembly for a threaded container neck comprising:

an internally threaded annular skirt adapted to interengage the threaded container neck and secure the closure on the container;

a top wall integral with said skirt and including an axial stepped delivery tube, said stepped delivery tube having a lower large diameter segment and an upper smaller diameter segment, the two segments being joined at an annular shoulder,;

a dip tube;

means connecting the dip tube to said delivery tube;

a stationary circular valve member supported by webs integral with the delivery tube, said circular valve member being disposed at the upper end of the delivery tube and spaced from said delivery tube to permit liquid flow past said valve member;

a delivery spout including a hollow tubular portion telescopically engaging the upper end of said delivery tube;

interengaging snap fit means on the interior of said hollow tubular portion of the delivery spout and the exterior of said delivery tube permitting rotary swiveling movement and axial reciprocating movement of the delivery spout toward and away from the valve member thereon;

said snap fit means comprising an annular bead on the interior of the axial tubular portion of the delivery spout intermediate its length and an annular bead on the exterior of the delivery tube near its upper end, said shoulder segment of the stepped delivery tube limiting axial downward travel of the delivery spout on the delivery tube and defining its axial lower position thereon, and said interior bead of the delivery spout limiting axial upward travel thereof and defining its upper limited position thereon;

an axial outlet passage in said tubular portion of said spout including a seat to receive said valve member and seal said outlet passage from the dip tube when the tubular portion of the spout is moved toward the top wall to the axial lower position and connect said passage with the dip tube when said tubular portion is moved away from said axial lower position toward said upper limited position.

2. The dispensing closure assembly set forth in claim 1 in which the dip tube is tightly connected over the lower end of said axial delivery tube in fluid tight relationship.

3. The dispensing closure assembly set forth in claim 1 in which the top wall includes fluid tight sealing means on its lower surface adapted to seal against the container around its opening, whereby flow out of and into the container is through said axial delivery tube and under control of said valve member.

4. The dispensing closure assembly set forth in claim 3 wherein said fluid tight sealing means comprises an annular V-shaped web integrally depending downwardly from said top wall.

5. The dispensing closure assembly set forth in claim 1 in which the delivery spout includes a radially extending portion connected with said hollow tubular portion for dispensing liquid in a remote radial position from said closure.

6. The dispensing closure assembly set forth in claim 5 wherein the said radial portion of the delivery spout extends laterally beyond the side of the container.

7. The dispensing closure assembly set forth in claim 5 wherein the delivery spout includes a planar top surface axially above said valve member for pushing the spout axially downwardly on the axial delivery tube and close the valve against the seat therefore closing the outlet passage.

8. A liquid dispensing package comprising:

a container having a threaded neck and rim defining a mouth opening, means for selectively pressurizing the interior of the container for dispensing liquid therefrom;

a closure assembly comprising an internally threaded annular skirt engaging said container over the mouth opening of the container and a top wall;

a delivery tube on said top wall and extending above said top wall, said delivery tube having a larger diameter lower segment and smaller diameter upper segment, said segments being connected by a shoulder, an integral stationary circular valve member at the upper end of the delivery tube and spaced from the end opening thereof to permit liquid flow past said valve member;

a dip tube connected to the lower end of said delivery tube and extending into liquid in the container, said dip tube sealingly connected exteriorly over the lower end of said delivery tube;

a delivery spout including a hollow axial tubular portion telescopically engaging the upper end of said delivery tube;

interengaging snap fit means comprising an annular bead on the interior of said hollow tubular portion of the delivery spout and an annular bead on the exterior of said delivery tube, said means permitting rotary swiveling movement and axial reciprocating movement of the delivery spout on the delivery tube between a lowered closed position and a raised open position;

said bead on the delivery tube defining the limit of the raised position of the delivery spout and said shoulder segment engaging said bead on the delivery spout to define its said lower position, an axial outlet passage in said tubular portion of said spout including a seat to receive said valve member and seal said outlet passage from the dip tube when the portion of the spout is moved toward the top wall to said axial lower position and connect said passage with the dip tube when said tubular portion is moved away from said axial lower position.

9. The liquid dispensing package of claim 8 in which the means for selectively pressurizing the interior of the container comprises a manually operable bellows connected into the container.

10. The liquid dispensing package of claim 8 wherein the means for selectively pressurizing the interior of the container comprises flexible walls of the container manually operable for compressing the container walls.

11. The liquid dispensing package of claim 10 where the container comprises a flexible plastic squeeze bottle.

12. The dispensing closure assembly set forth in claim 8 in which the delivery spout includes a radially extending hollow tube portion connected with said hollow axial tubular portion for dispensing liquid in a remote radial position from said closure.

13. The dispensing closure assembly set forth in claim 12 wherein the said radial portion of the delivery spout extends laterally beyond the side of the container.

14. The dispensing closure assembly set forth in claim 12 wherein the delivery spout includes a planar top surface axially above said value member for pushing the spout axially downwardly on the closure delivery tube to said lower position and close the valve against the seat and therefore the outlet passage.

15. The dispensing closure assembly set forth in claim 8 in which the top wall includes fluid tight sealing means on its lower surface engaging the rim of the container forming a seal around its mouth opening, whereby flow out of and into the container is through said axial tubular member of the closure and under control of said valve member.

16. The dispensing closure assembly set forth in claim 15 wherein said fluid tight sealing means comprises an annular V-shaped web integrally depending downwardly from said top wall and engaging the top surface of said rim at the mouth of the container.

* * * * *